US009076617B2

(12) United States Patent
Yamashita et al.

(10) Patent No.: US 9,076,617 B2
(45) Date of Patent: Jul. 7, 2015

(54) ELECTROMAGNETIC RELAY

(75) Inventors: Tsukasa Yamashita, Yamaga (JP); Tetsuo Shinkai, Yamaga (JP); Yasuyuki Masui, Kumamoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/982,746

(22) PCT Filed: Mar. 24, 2011

(86) PCT No.: PCT/JP2011/057131
§ 371 (c)(1),
(2), (4) Date: Oct. 15, 2013

(87) PCT Pub. No.: WO2012/124164
PCT Pub. Date: Sep. 20, 2012

(65) Prior Publication Data

US 2014/0028418 A1 Jan. 30, 2014

(30) Foreign Application Priority Data

Mar. 14, 2011 (JP) ..... 2011-055725

(51) Int. Cl.
*H01H 9/30* (2006.01)
*H01H 50/00* (2006.01)
(Continued)

(52) U.S. Cl.
CPC ..... *H01H 50/00* (2013.01); *H01H 9/40* (2013.01); *H01H 9/443* (2013.01); *H01H 50/02* (2013.01); *H01H 50/26* (2013.01); *H01H 50/28* (2013.01); *H01H 50/305* (2013.01); *H01H 50/54* (2013.01)

(58) Field of Classification Search
CPC ..... H01H 51/065; H01H 51/01; H01H 51/06; H01H 9/02; H01H 9/46; H01H 9/443; H01H 50/00; H01H 50/60; H01H 50/36; H01H 50/38; H01H 50/546; H01H 71/0235; H01H 9/34; H01H 9/44; H01H 2050/049; H01H 77/108; H01F 7/14; H01F 7/1646; H02H 1/0007; H02K 49/10
USPC ..... 335/201
See application file for complete search history.

(56) References Cited

U.S. PATENT DOCUMENTS 2,735,968 A * 2/1956 Bogue et al. ..... 335/275
2,875,304 A * 2/1959 White ..... 218/26
(Continued)

FOREIGN PATENT DOCUMENTS

JP 55-11064 1/1980
JP 55-34346 3/1980
(Continued)

*Primary Examiner* — Shawki S Ismail
*Assistant Examiner* — Lisa Homza
(74) *Attorney, Agent, or Firm* — Klarquist Sparkman, LLP

(57) ABSTRACT

An electromagnetic relay including a contact switching unit formed by arranging at least two contact groups, in parallel with each other and perpendicular to the touch/separation direction of the contacts, each of the contact group includes a pair of contacts that can touch and separate; an electromagnet block that drives the contact switching unit to open and close the contacts; and an arc-extinguishing member comprising a connection member made from a magnetic material and formed by a connection of protrusions that respectively protrude from both sides of a middle part in the direction of the parallel arrangement of the contact groups and between the contact groups, and also comprising permanent magnets respectively disposed at least on the opposing positions of the protrusions located on both sides of the middle part.

13 Claims, 14 Drawing Sheets

(51) Int. Cl.

| | |
|---|---|
| ***H01H 9/40*** | (2006.01) |
| ***H01H 9/44*** | (2006.01) |
| ***H01H 50/54*** | (2006.01) |
| *H01H 50/02* | (2006.01) |
| *H01H 50/26* | (2006.01) |
| *H01H 50/28* | (2006.01) |
| *H01H 50/30* | (2006.01) |

(56) References Cited

U.S. PATENT DOCUMENTS

| | | | | | |
|---|---|---|---|---|---|
| 3,800,250 | A | * | 3/1974 | Mori et al. | 335/128 |
| 4,302,742 | A | * | 11/1981 | Schedele | 335/202 |
| 4,367,448 | A | * | 1/1983 | Nishizako | 335/201 |
| 4,618,842 | A | * | 10/1986 | Nestlen et al. | 335/128 |
| 4,758,809 | A | * | 7/1988 | Bell | 335/128 |
| 4,761,627 | A | * | 8/1988 | Bell | 335/128 |
| 4,786,770 | A | * | 11/1988 | Hamano et al. | 218/23 |
| 4,825,179 | A | * | 4/1989 | Nagamoto et al. | 335/80 |
| 4,958,137 | A | * | 9/1990 | Schroeder | 335/128 |
| 5,017,898 | A | * | 5/1991 | Kuzukawa | 335/128 |
| 5,109,146 | A | * | 4/1992 | Maenishi | 218/26 |
| 5,160,910 | A | * | 11/1992 | Tsuji | 335/129 |
| 5,202,663 | A | * | 4/1993 | Tomono et al. | 335/86 |
| 5,204,647 | A | * | 4/1993 | Mitsuki et al. | 335/80 |
| 5,289,144 | A | * | 2/1994 | Liao | 335/78 |
| 5,321,377 | A | * | 6/1994 | Aharonian | 335/78 |
| 5,392,015 | A | * | 2/1995 | Matsuoka et al. | 335/78 |
| 5,396,204 | A | * | 3/1995 | Matsuoka et al. | 335/78 |
| 5,514,844 | A | * | 5/1996 | Hamano et al. | 218/57 |
| 5,546,061 | A | * | 8/1996 | Okabayashi et al. | 335/78 |
| 5,568,108 | A | * | 10/1996 | Kirsch | 335/130 |
| 5,572,176 | A | * | 11/1996 | Heinzl et al. | 335/129 |
| 5,680,082 | A | * | 10/1997 | Stocklin | 335/128 |
| 5,757,255 | A | * | 5/1998 | Noda et al. | 335/78 |
| 5,805,040 | A | * | 9/1998 | Corcoran | 335/202 |
| 5,864,270 | A | * | 1/1999 | Hoffman | 335/78 |
| 5,907,268 | A | * | 5/1999 | Mader | 335/202 |
| 5,969,586 | A | * | 10/1999 | Noda et al. | 335/83 |
| 6,034,582 | A | * | 3/2000 | Fausch | 335/78 |
| 6,323,747 | B1 | * | 11/2001 | Mader et al. | 335/80 |
| 6,486,760 | B2 | * | 11/2002 | Miyazaki et al. | 335/78 |
| 6,606,018 | B2 | * | 8/2003 | Takano et al. | 335/78 |
| 6,700,466 | B1 | * | 3/2004 | Yamamoto et al. | 335/132 |
| 6,731,190 | B2 | * | 5/2004 | Yamashita et al. | 335/78 |
| 6,903,638 | B2 | * | 6/2005 | Nakamura et al. | 335/78 |
| 7,205,870 | B2 | * | 4/2007 | Sanada et al. | 335/78 |
| 7,477,119 | B2 | * | 1/2009 | Wu | 335/83 |
| 7,750,769 | B2 | * | 7/2010 | Minowa et al. | 335/78 |
| 7,782,162 | B2 | * | 8/2010 | Nishida | 335/201 |
| 7,859,371 | B2 | * | 12/2010 | Takano | 335/78 |
| 7,994,884 | B2 | * | 8/2011 | Kuo | 335/78 |
| 8,111,117 | B2 | * | 2/2012 | Minowa et al. | 335/78 |
| 8,193,881 | B2 | * | 6/2012 | Yuba et al. | 335/78 |
| 8,653,917 | B2 | * | 2/2014 | Takaya et al. | 335/201 |
| 2003/0231090 | A1 | * | 12/2003 | Copper et al. | 335/128 |
| 2005/0057332 | A1 | * | 3/2005 | Nakamura et al. | 335/128 |
| 2006/0279384 | A1 | * | 12/2006 | Takayama et al. | 335/78 |
| 2009/0134962 | A1 | * | 5/2009 | Nishida | 335/207 |
| 2009/0322453 | A1 | * | 12/2009 | Kawaguchi et al. | 335/81 |
| 2013/0113581 | A1 | * | 5/2013 | Kakimoto et al. | 335/196 |

FOREIGN PATENT DOCUMENTS

| | | | |
|---|---|---|---|
| JP | 55-034346 | | 3/1980 |
| JP | 60-107551 | | 7/1985 |
| JP | H 10-154448 | | 11/1996 |
| JP | 10-154448 | | 6/1998 |
| JP | 2001-176370 | | 6/2001 |
| JP | 2009-087918 | A | 9/2007 |
| JP | 2007-305466 | | 11/2007 |
| JP | 5085754 | | 11/2012 |

* cited by examiner

ELECTROMAGNETIC RELAY

CROSS REFERENCE TO RELATED APPLICATION

This application claims benefit of priority to Japanese Patent Application No. 2011-055725, filed on Mar. 14, 2011 of which the full contents are herein incorporated by reference.

The present invention relates to an electromagnetic relay.

BACKGROUND OF THE INVENTION

Conventionally, an electromagnetic relay in which an electromagnet block formed by winding a coil around an iron core with a spool interposed therebetween is magnetized or demagnetized to pivot a moving iron, which is supported pivotably by a yoke swaged and anchored to the iron core, and to drive a movable touch piece so that a movable contact opens and closes with respect to a fixed contact of a fixed touch piece arranged facing the movable touch piece is known from Japanese Unexamined Patent Publication No. 2009-87918.

In this electromagnetic relay, a permanent magnet is arranged on an upper side of a contact switching unit to generate a magnetic field between the contacts so that when an arc current generates at the time of contact opening/closing, the arc current can be extended toward the side and extinguished at an early stage.

However, the magnetic field is generated by a single permanent magnet arranged on the upper side of the contact switching unit in the conventional electromagnetic relay. The magnetic field generated downward from the N pole which is the lower side of the permanent magnet, is directed from between the contacts toward the side, and then toward the upper side along each touch piece to reach the S pole which is the upper side of the permanent magnet. Thus, there is a problem that the magnetic flux easily leaks to the peripheral space and cannot concentrate at the contact switching unit. As a result, a permanent magnet that exerts a strong magnetic force becomes necessary, which leads to increase in cost.

SUMMARY OF THE INVENTION

It is an object of the present invention to provide a small and inexpensive electromagnetic relay having an arc extinguishing function capable of extinguishing an arc generated at the time of contact opening/closing at an early stage.

BACKGROUND OF THE INVENTION

According to an embodiment of an electromagnetic relay, the electromagnetic relay includes a contact switching unit formed by arranging at least two contact groups, in parallel with each other and perpendicular to a touch/separation direction of the contacts, each of the contact groups includes a pair of contacts which are adapted to touch each other and separate from each other, an electromagnet block that drives the contact switching unit to open/close the contacts, and an arc extinguishing member including a connection member made from a magnetic material and formed by a connection, of projecting sections that respectively project out from both sides of a middle part in the direction of the parallel arrangement of the contact groups and between the contact groups, and permanent magnets respectively disposed at least on the opposing positions of the projecting section located on both sides of the middle part.

The electromagnetic relay preferably includes a case to be attached to a base to cover the contact switching unit and the electromagnet block, wherein the case includes a recessed portion to which the projecting section and the permanent magnet of the arc extinguishing member can be arranged.

Preferably, a polarity of an opposing surface of each permanent magnet and a direction in which an arc current generated at a time of contact opening/closing flow are determined so that a force of displacing toward the middle part of the connection member is generated on the arc current.

In an alternate embodiment, a polarity of an opposing surface of each permanent magnet and a direction in which an arc current generated at a time of contact opening/closing flow may be determined to be in opposite directions between the adjacent contact open/close positions.

The electromagnetic relay preferably includes a base to be attached with the contact switching unit and the electromagnet block, wherein the contact is fixed to one end section of a touch piece that projects out from the base, and the arc extinguishing member has the middle part of the connection member arranged near the contact on a projecting direction side of the touch piece.

According to another embodiment of the electromagnetic relay, an electromagnetic relay includes a contact switching unit having a fixed touch piece and a movable touch piece facing the fixed touch piece, an electromagnet block being magnetized or demagnetized to drive the movable touch piece so that a movable contact arranged in the movable touch piece opens/closes with respect to a fixed contact arranged in the fixed touch piece; wherein at least two fixed touch pieces including the fixed contact are provided, the movable touch piece includes at least a pair of contact piece portions including the movable contact, and an arc extinguishing member including a connection member having projecting sections projecting out from both sides of each touch piece portion and connected with each other via a middle part between the open/close positions of the contact and permanent magnets respectively disposed at each of the opposing positions of the projecting sections located on both sides.

In one embodiment of the electromagnetic relay, the connection member of the arc extinguishing member is formed by an opposing wall at both ends of an intermediate wall, and side parts are raised from the opposing wall side on opposite sides with respect to a central part to form the projecting section located between the contact groups at the central part of the intermediate wall.

In another embodiment of the electromagnetic relay, a flat plate-shaped wall surface portion may be configured with the projecting sections.

In yet another embodiment of the electromagnetic relay, the connection member of the arc extinguishing member includes a first connecting portion and a second connecting portion, each connecting portion being configured by forming a first side wall and a second side wall at both ends of the intermediate wall so as to face each other; and the projecting section located between the contact groups being configured by the second side walls.

In an alternate embodiment of the electromagnetic relay, the second side wall of the first connecting portion and the second side wall of the second connecting portion may configure a flat plate-shaped wall surface portion.

BRIEF DESCRIPTION OF THE DRAWINGS

FIG. 5 is an exploded perspective view showing a state in which FIG. 4 is seen from the opposite side.

DETAILED DESCRIPTION

Figure 1:
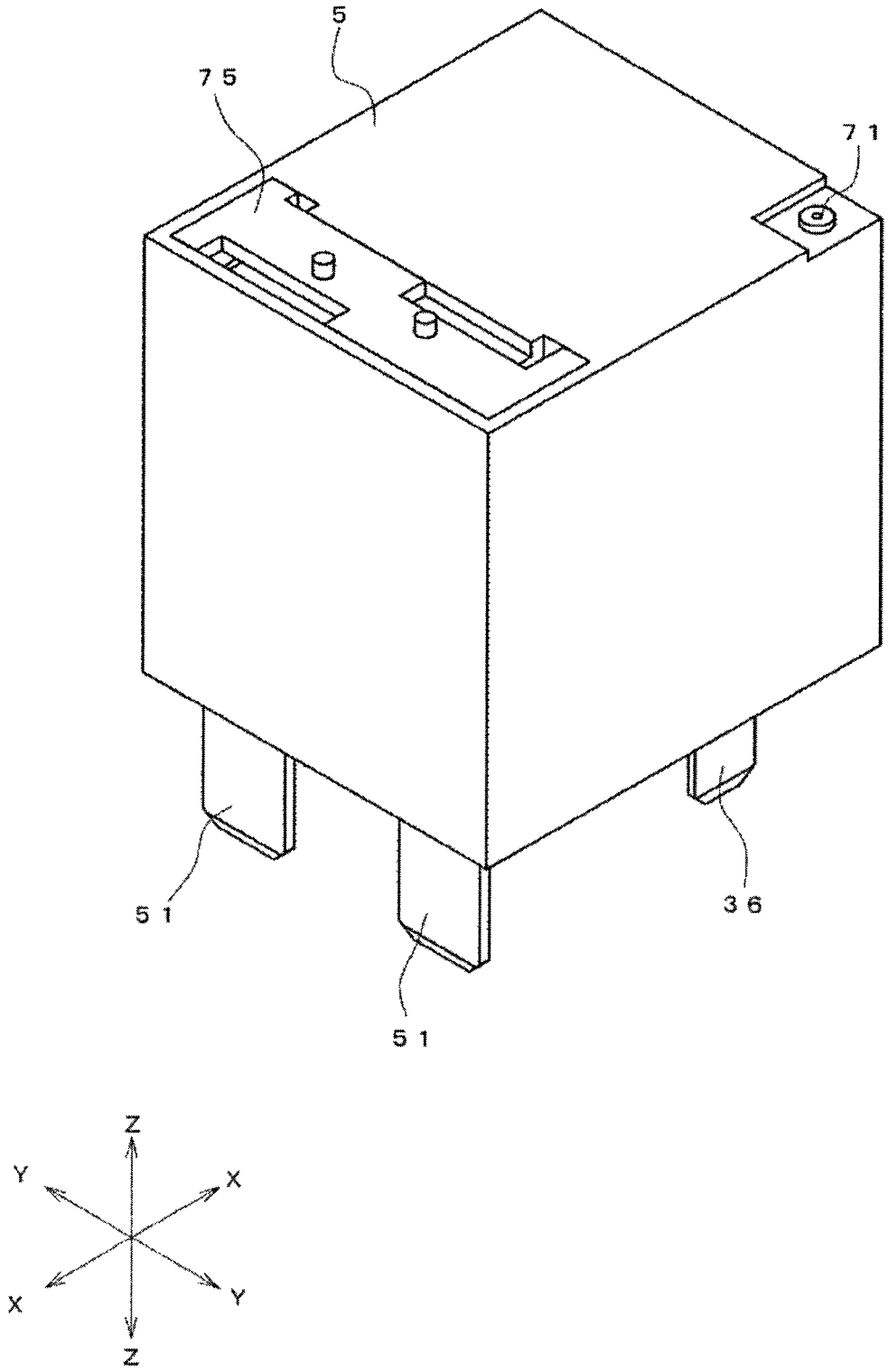
FIG. 1 is a perspective view of an electromagnetic relay according to the present embodiment.

An embodiment according to the present invention will be hereinafter described according to the accompanying drawings. In the following description, terms (e.g., terms including "up", "down", "side", "end") indicating a specific direction or position are used as necessary but the use of the terms are merely to facilitate the understanding of the invention that references the drawings, and it should be recognized that the technical scope of the invention is not to be limited by the meaning of the terms. Furthermore, the following description is merely illustrative in essence, and is not intended to limit the present invention, the applied articles and the applications thereof.

FIGS. 1 to 5 show an electromagnetic relay according to the present embodiment. The electromagnetic relay is roughly obtained by arranging an electromagnet block 2, a contact switching unit 3, and a moving iron 4 on a base 1 and placing a case 5 thereon.

Figure 6A:
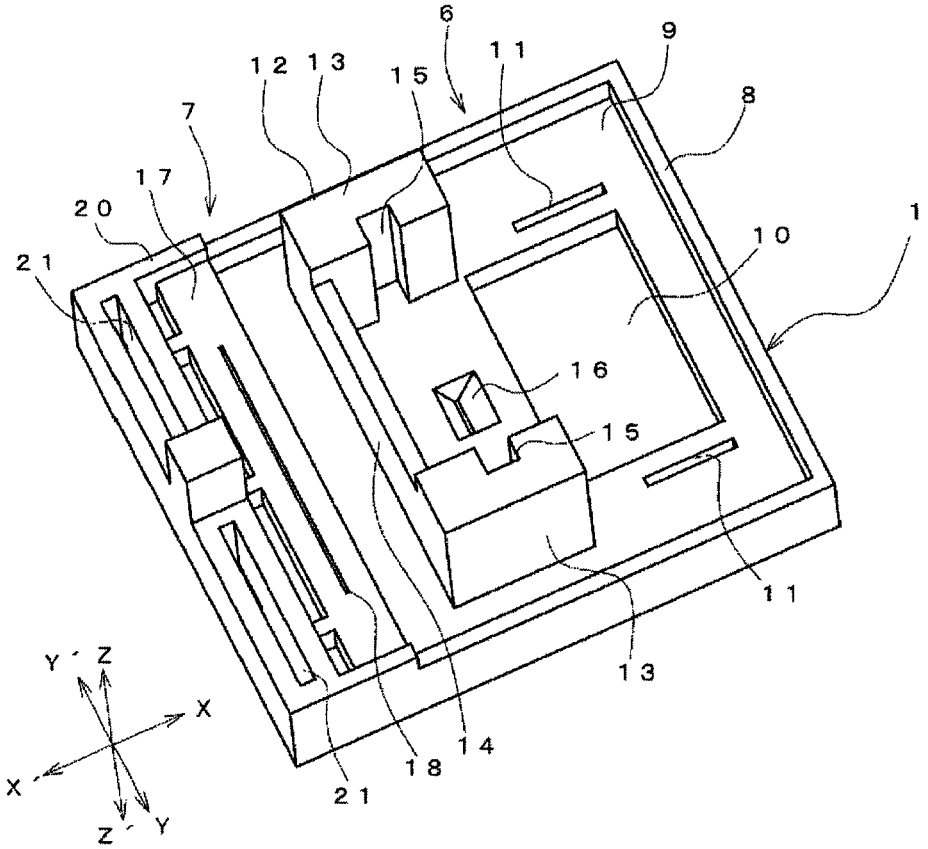
FIG. 6A is a perspective view showing a state in which a base is seen from an upper side.
Figure 6B:
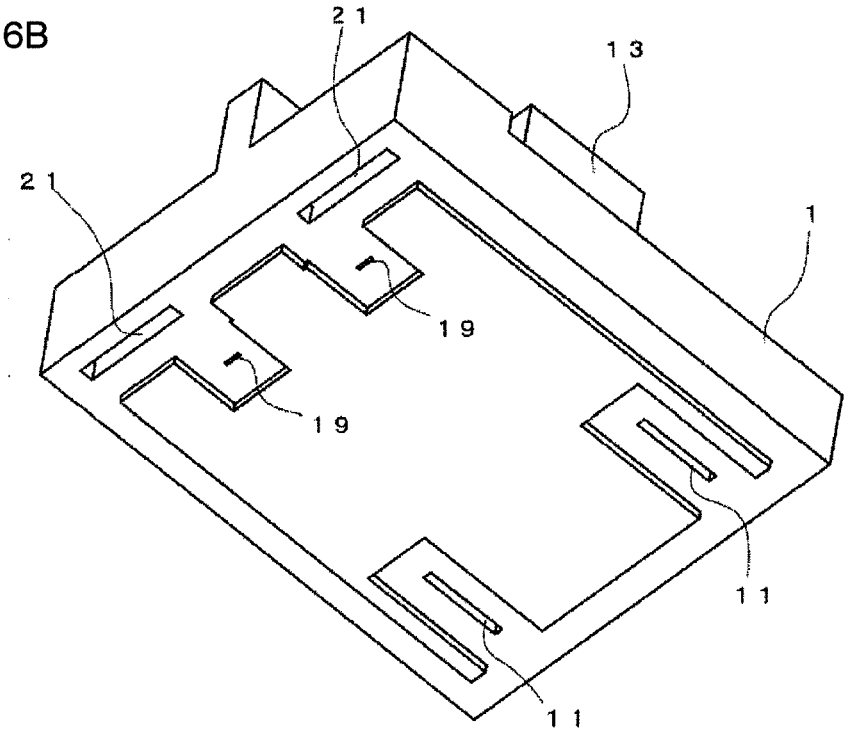
FIG. 6B is a perspective view showing a state in which the base is seen from a lower side.

As shown in FIG. 6, the base 1 is formed into a rectangular shape in a plan view by a forming process on a synthetic resin material, and a first attachment section 6 and a second attachment section 7 are arranged at two areas in a longitudinal direction (hereinafter, description will be made assuming a direction extending in the longitudinal direction along a long side as X-axis, a direction extending in a short-side direction along a short side as Y-axis, and a direction extending in a height direction as Z-axis).

The first attachment section 6 is provided to attach the electromagnet block 2, to be described later, and has a supporting recessed portion 10 formed in a recessed area 9 surrounded by a first peripheral edge wall 8 and the second attachment section 7. On a bottom surface of the recessed area 9, a pair of coil terminal holes 11 passing through the upper and lower surfaces are respectively formed on both sides of the supporting recessed portion 10 (short side direction of the base 1: YY' direction). A guide portion 12 is formed in the vicinity (longitudinal direction of the base 1) of the supporting recessed portion 10. The guide portion 12 is configured with a pair of guide walls 13 arranged in correspondence with the short-side direction (YY' direction), and an insulating wall 14 that connects the guide walls. A guide groove 15 extending in an up and down direction is formed on each opposing surface of the guide walls 13. The guide grooves 15 guide both side parts of a yoke 41, to be described later. A guide recessed portion 16 is formed at a central portion of a region surrounded by the guide walls 13 and the insulating wall 14. A section 50 to be guided of a hinge spring 44, to be described later, is located in the guide recessed portion 16.

The second attachment section 7 is provided to attach the contact switching unit 3, and is formed with a base portion 17 of the same height as the first peripheral edge wall 8 of the first attachment section 6. The base portion 17 is formed with a slit-like first terminal hole 18 that extends in the YY' direction. The first terminal hole 18 passes through only at a communicating portion 19 at two areas on both sides in the bottom surface of the base 1, so that a movable touch piece 52, to be described later, can be press-fitted thereto. A second peripheral edge wall 20 is formed from three sides except the first attachment section side of the base portion 17. A portion configuring the X' direction side of the second peripheral edge wall 20 has a large thickness, and a pair of slit-like second terminal holes 21 extending in the YY' direction are respectively formed thereat. A fixed touch piece 51, to be described later, is to be press-fitted and anchored in each second terminal hole 21.

Figure 7:
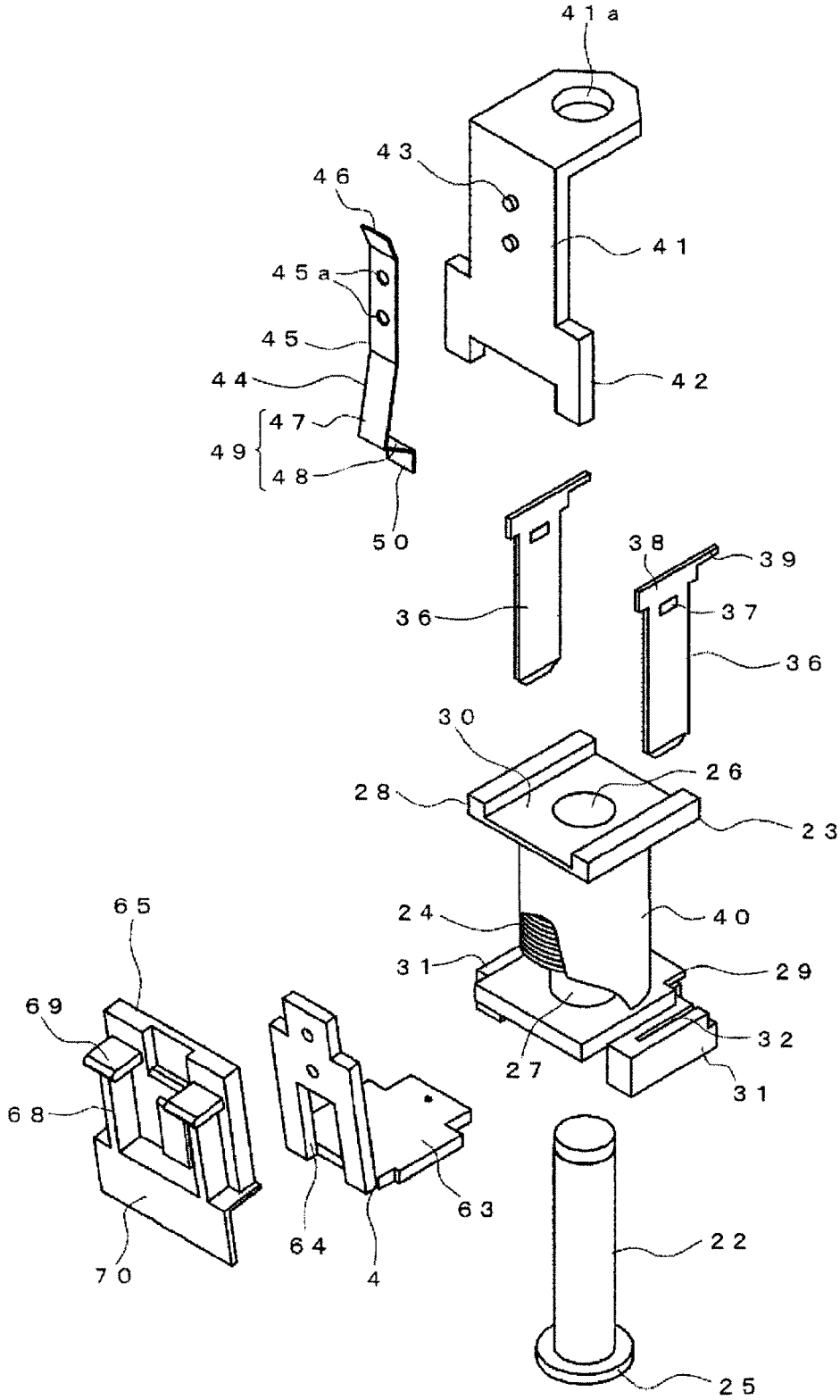
FIG. 7 is an exploded perspective view of an electromagnet block and a moving iron shown in FIG. 2.
Figure 8:
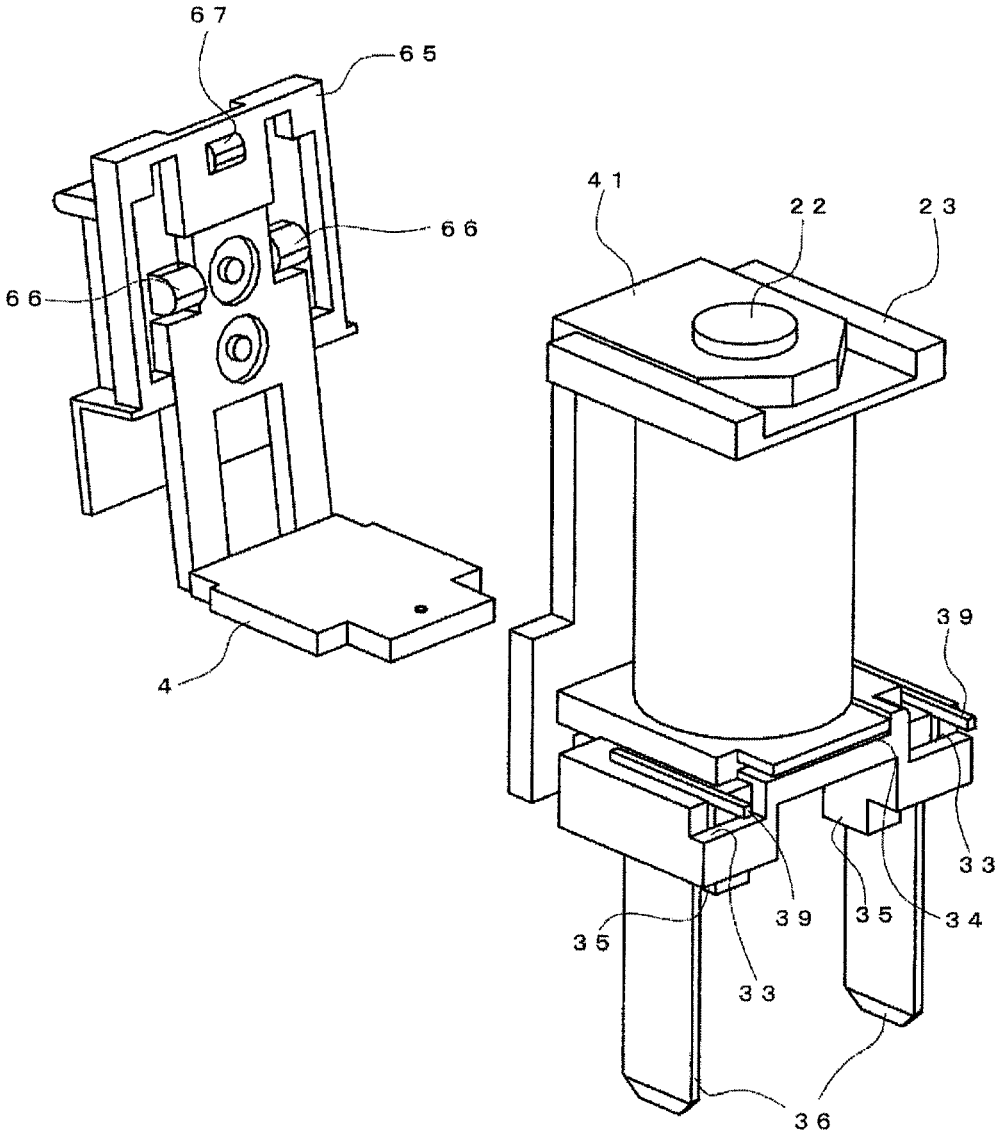
FIG. 8 is an exploded perspective view of the electromagnet block and the moving iron shown in FIG. 2.

As shown in FIGS. 7 and 8, the electromagnet block 2 is formed by winding a coil 24 around an iron core 22 with a spool 23 interposed therebetween.

The iron core 22 is formed into a rod-shape with a magnetic material, where a guard shaped magnet pole section 25 is formed at a lower end section and a yoke 41 is swaged and anchored at an upper end section.

The spool 23 is obtained by a forming process on a synthetic resin material, and is configured with a tubular body portion 27 that forms a center hole 26, and guard portions (upper end guard portion 28 and lower end guard portion 29) formed on both upper and lower end sections.

The upper end guard portion 28 has an escape groove 30 formed on the upper surface, and the center hole 26 is opened thereat. One end of the yoke 41, to be described later, is arranged in the escape groove 30. The center hole 26 is opened at the lower end guard portion 29, so that the iron core 22 can be inserted therefrom.

A terminal attachment portion 31 is provided on both sides of the lower end guard portion 29, and a terminal holding hole 32 is formed thereat. A coil terminal 36, to be described later, is press-fitted and anchored in each terminal holding hole 32. A step portion 33 is formed on both sides of one end of the terminal attachment portion 31, so that a coil winding portion 39 of the coil terminal 36 press-fitted and anchored in the terminal holding hole 32 projects out. On the lower end guard portion 29 is formed with a guiding groove 34 communicating to one step portion 33 from the body portion 27 toward the side end face. One end side (winding start side) of the coil 24 to be wound around the body portion 27 is arranged in the guiding groove 34, and is wound around the coil winding portion 39 of the coil terminal 36 projecting out at the step portion 33. A pair of guide projections 35 is arranged at a predetermined interval on the bottom surface of the lower end guard portion 29. The guide projections 35 are located in the supporting recessed portion 10 of the base 1, to play a role of positioning the spool 23, that is, the electromagnet block 2 with respect to the base 1.

The coil terminal 36 is formed into a flat plate shape with a conductive material, and the lower end section is formed such that the width and the thickness gradually become smaller toward the lower side. The upper end section of the coil terminal 36 is formed with a press-fit portion 37 that bulges out from one surface by press working, where the upper portion is a wide width portion 38. The coil winding portion 39 projects out from one end of the wide width portion 38.

The coil 24 is wound around the body portion 27 of the spool 23, and then an insulating sheet 40 is adhered to the outer peripheral surface. One end section of the coil 24 is arranged in the guiding groove 34 of the spool 23, and after being wound around the body portion 27 of the spool 23, both ends are respectively wound around the coil winding portion 39 of each coil terminal 36 and then soldered.

The yoke 41 is swaged and anchored to one end of the iron core 22. The yoke 41 is formed by bending the magnetic material to a substantially L-shape. One end section of the yoke 41 is formed with an opening 41*a* for inserting one end of the iron core 22 and swaging and anchoring the same. The other end section of the yoke 41 becomes a wide width, and a projecting section 42 is formed on both sides of the lower end section. The moving iron 4, to be described later, is located between the projecting sections 42 and one corner functions as a fulcrum for pivotably supporting the moving iron 4. A protrusion 43 for swaging is formed at two, upper and lower areas on the outer surface of the middle part of the yoke 41.

The hinge spring 44 is swaged and anchored using the protrusion 43 at the middle part of the yoke 41. However, the method of anchoring the hinge spring 44 to the yoke 41 is not limited to swaging, and may be performed with other methods such as ultrasonic welding, resistance welding, laser welding, and the like.

The hinge spring 44 includes a connecting portion 45 to be area contacted to the outer surface of the middle part of the yoke 41. A through-hole 45*a* is formed at two areas in the connecting portion 45, so that the protrusion 43 of the yoke 41 can be inserted and swaged therein.

The upper portion of the connecting portion 45 is an elastic contacting portion 46 that extends at a predetermined angle so as to gradually separate from the outer surface of the middle part of the yoke 41. The elastic contacting portion 46 can elastically contact a pushing receiving portion of a card member 65 arranged in the moving iron 4, to be described later. The elastic contacting portion 46 alleviates the generation of collision noise when the moving iron 4 returns to the original position.

The lower portion of the connecting portion 45 is an elastic support 49 including a first inclined portion 47 that extends at a predetermined angle so as to gradually separate from the outer surface of the middle part of the yoke 41, and a second inclined portion 48 that extends at a predetermined angle so as to gradually approach the yoke side from the first inclined portion 47. The elastic support 49 elastically supports the moving iron 4 pivotably when the second inclined portion 48 pressure contacts the moving iron 4, to be described later.

The lower portion of the elastic support 49 is the section 50 to be guided that extends vertically downward with the moving iron 4 elastically supported by the elastic support 49. The section 50 to be guided is arranged in the guide recessed portion 16 formed in the first attachment section 6 of the base 1, and the hinge spring 44 is prevented from position shifting by being guided by the guide recessed portion 16.

Figure 4:
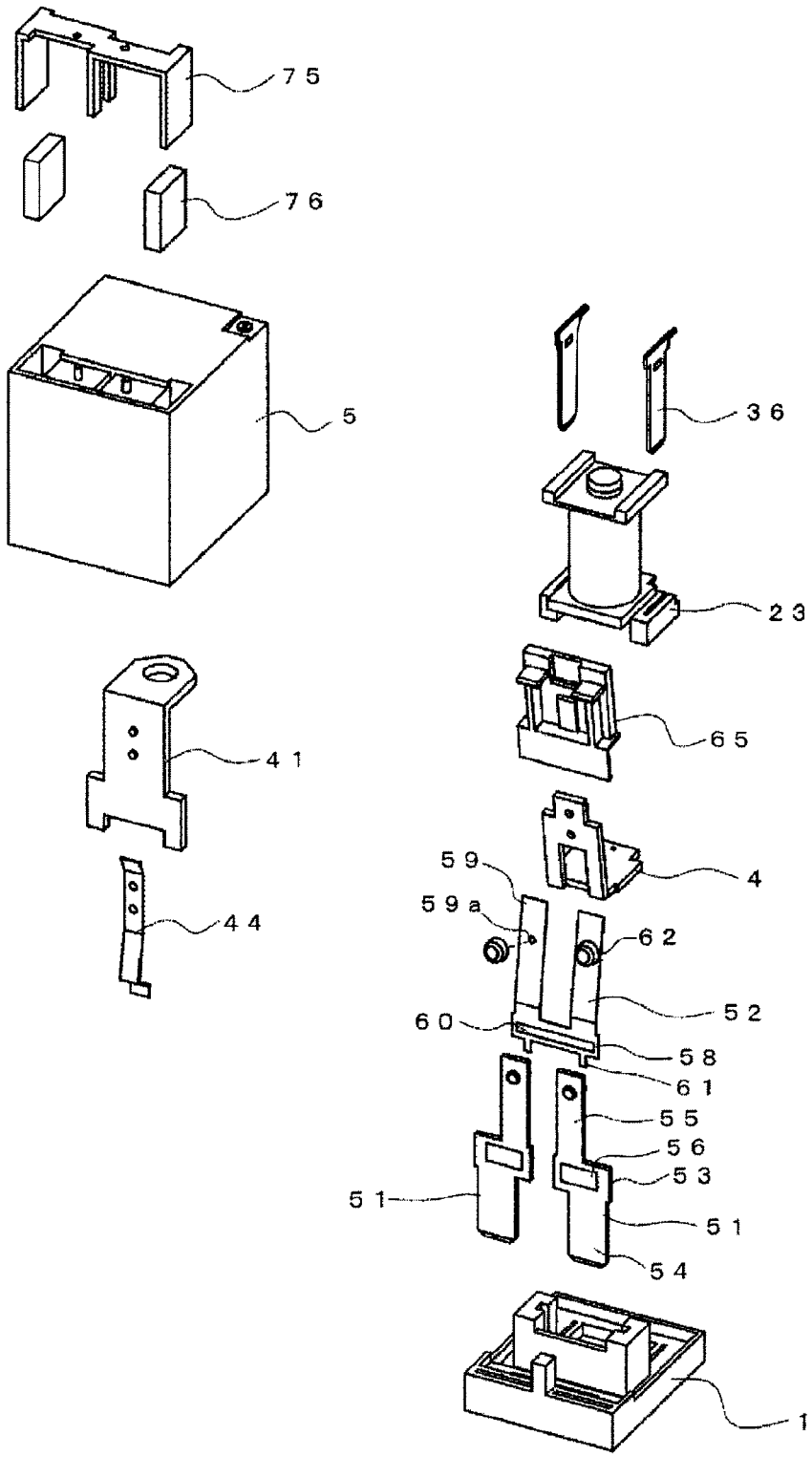
FIG. 4 is an exploded perspective view of FIG. 1.
Figure 5:
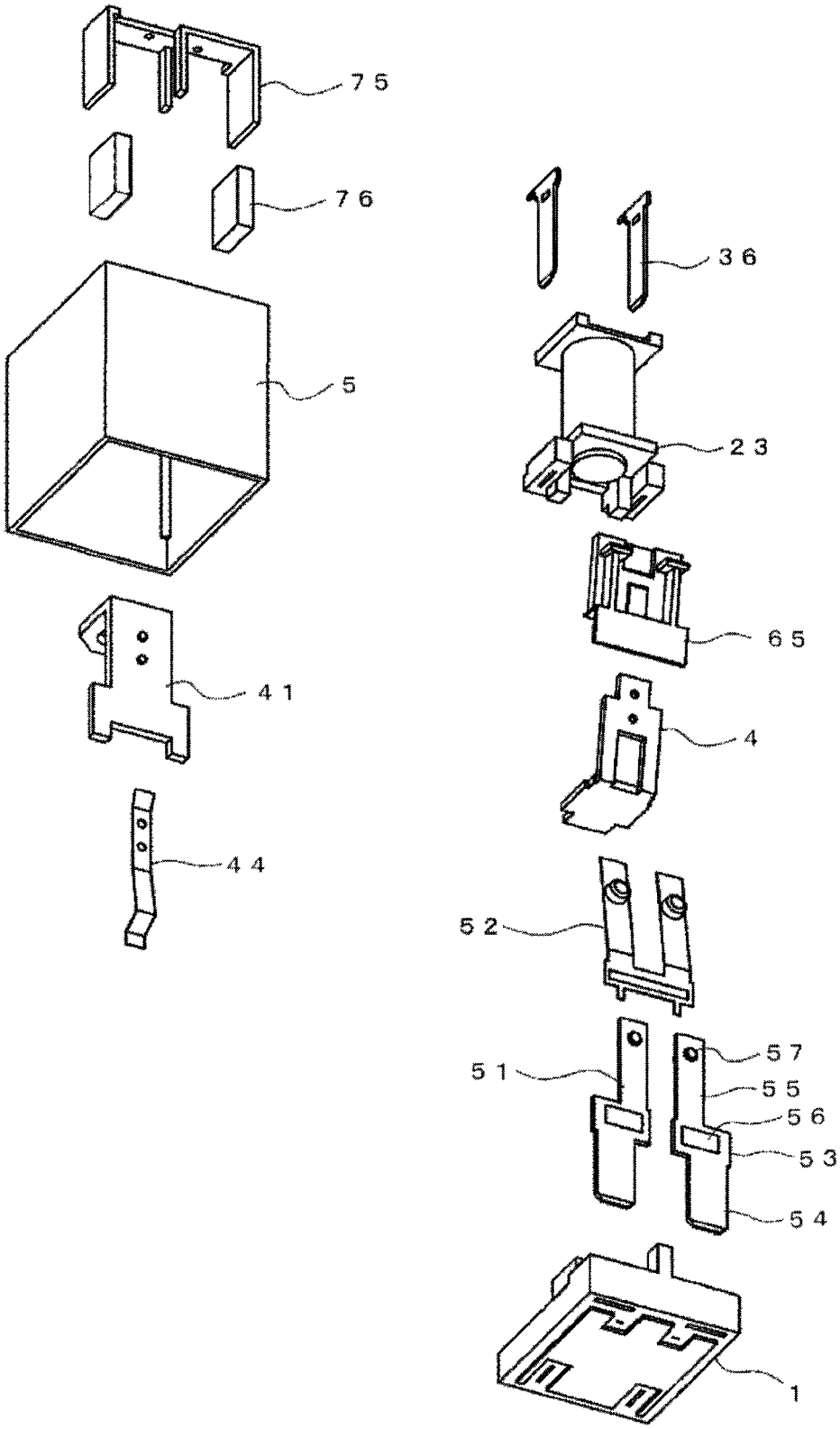

As shown in FIGS. 4 and 5, the contact switching unit 3 is configured with a fixed touch piece 51 and a movable touch piece 52 in which the conductive material such as copper is press worked to a plate shape.

The fixed touch piece 51 is configured with a press-fit portion 53, a terminal portion 54 extending to the lower side from the press-fit portion 53, and a touch piece portion 55 extending to the upper side from the press-fit portion 53. The press-fit portion 53 is formed with a bulging out portion 56 that bulges out from one surface by press working. The second terminal hole 21 of the base 1 can be press-fitted by the bulging out portion 56. The terminal portion 54 has a narrower width than the press-fit portion 53 and is formed with the position shifted to one side. The touch piece portion 55 is formed with the position shifted to the side opposite to the terminal portion 54, and has a width dimension of substantially the half of the press-fit portion 53. A through-hole is formed at the upper end of the touch piece portion 55, and the fixed contact 57 is swaged and fixed thereat.

The movable touch piece 52 is configured with a press-fit portion 58, and a pair of touch piece portions 59 respectively extending to the upper side from both sides of the press-fit portion 58. The press-fit portion 58 is formed with a bulging out portion 60 extending in the width direction at a central part in the up and down direction, similar to the fixed touch piece 51, and can be press-fitted into the first terminal hole 18 of the base 1. A pair of protrusions 61 that projects out downward is formed at both ends of the lower edge of the press-fit portion 58. The touch piece portion 59 is bent at the proximate portion of the press-fit portion 58 and then extended, where a through-hole 59*a* is formed at the upper end section and the movable contact 62 is swaged and fixed therein. The movable touch piece 52 faces the fixed contact 57 of the fixed touch piece 51 in which the movable contact 62 is press-fitted into the second terminal hole 21 so as to touch and separate the fixed contact with the press-fit portion 58 press-fitted into the first terminal hole 18 of the base 1.

As shown in FIGS. 7 and 8, the moving iron 4 is formed into a substantially L-shape by press working a plate-like magnetic material. One end side of the moving iron 4 is a section 63 to be drawn that is drawn to the magnet pole section 25 of the iron core 22. The leading end portion and the base portion of the section 63 to be drawn have a narrow width, and the interference of the guide projection 35 formed on the bottom surface of the spool 23 and the projecting section 42 formed on the lower end section of the yoke 41 is avoided. An opening 64 is formed on the other end side of the moving iron 4. The hinge spring 44 is inserted to the opening 64, and is pressure contacted to the corner of the section 63 to be drawn. The other end section of the moving iron 4 has a narrow width, and the card member 65 is integrated at the upper side of the opening 64.

The card member 65 is made of synthetic resin material, and a first projecting section 66 formed on both sides of the upper end section of the moving iron 4 and a second projecting section 67 formed on the upper side are respectively formed on one surface where the upper end side of the integrated moving iron 4 is exposed. When the section 63 to be drawn of the moving iron 4 separates from the magnet pole section 25 of the iron core 22, the elastic contacting portion 46 of the hinge spring 44 collides with the second projecting section 67 and then the first projecting section 66 comes into contact with the yoke 41. A projected thread section 68 extending in the up and down direction is formed at a predetermined interval in the width direction on the other surface of the card. A pushing portion 69 that further projects out is formed at the upper end section portion of the projected thread section 68, so that the upper end section of the touch piece portion 55 of the movable touch piece 52 can be pushed. A shielding wall 70 that projects out more than the other surface and that extends further to the lower side is formed at the lower end section of the card member 65.

Figure 2:
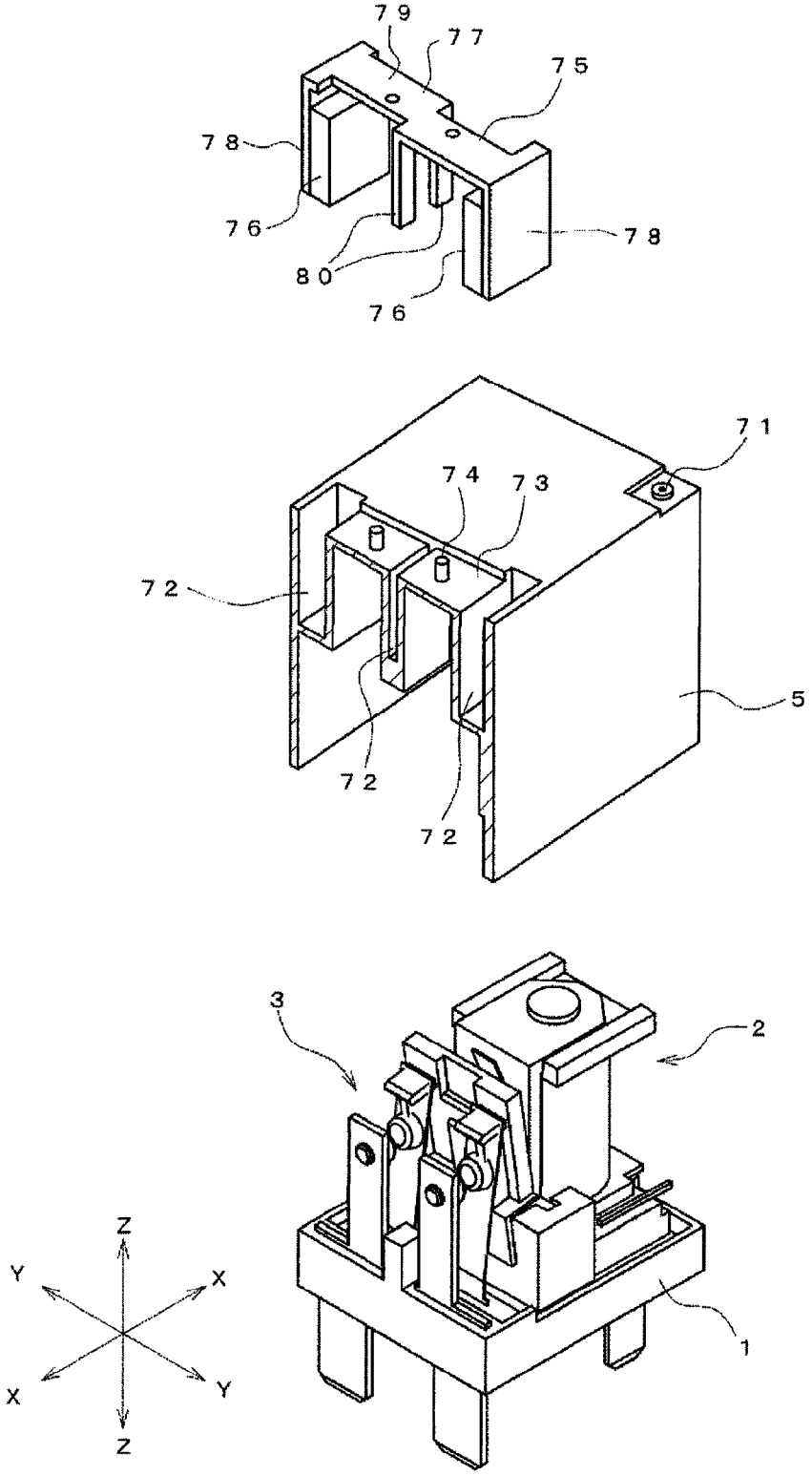
FIG. 2 is a perspective view showing a state in which a case and an arc extinguishing member are exploded from FIG. 1.
Figure 3:
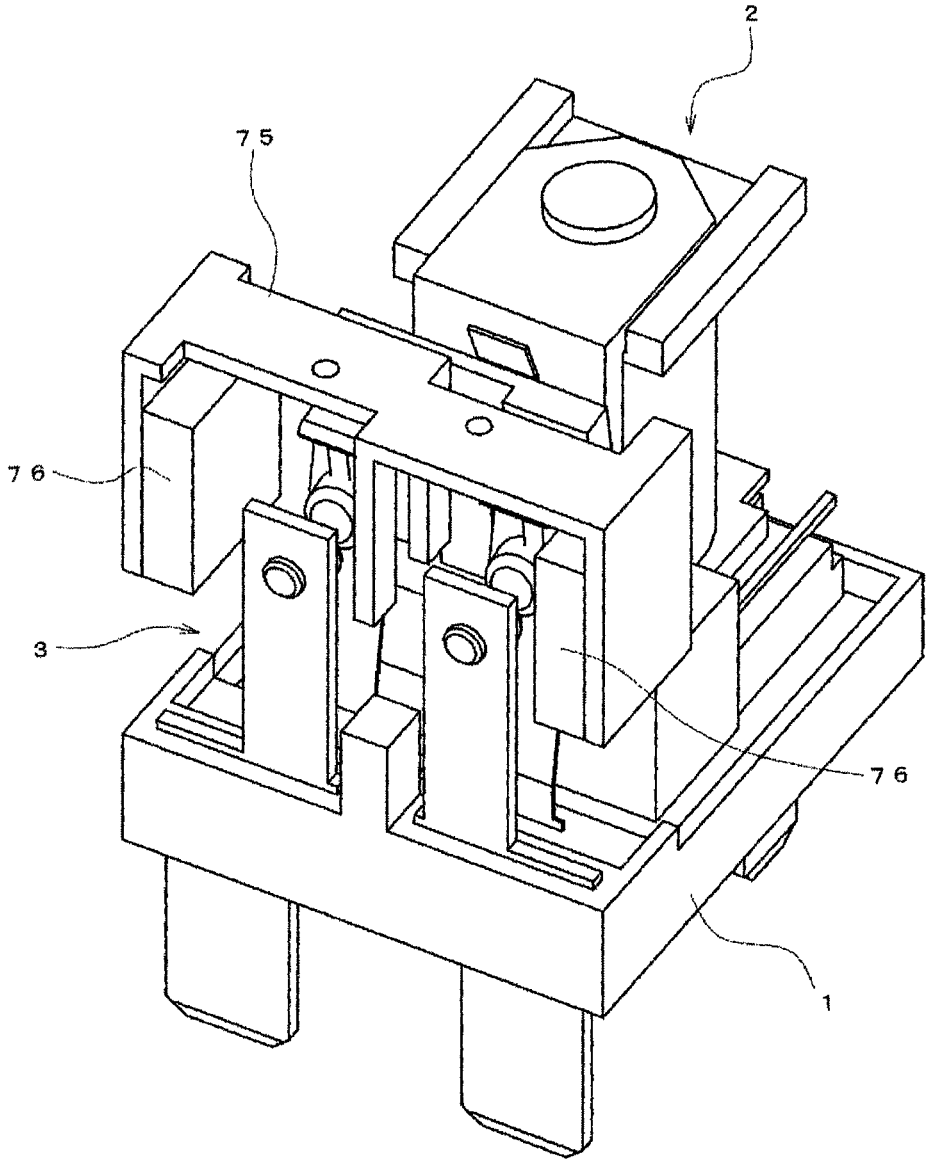
FIG. 3 is a perspective view showing a state in which only the case is removed from FIG. 1.

As shown in FIG. 2, the case 5 is made of a synthetic resin material and formed into a box-shape having an opened lower surface. A sealing hole 71 is formed at the corner of the upper surface of the case 5. The sealing hole 71 is thermally sealed after sealing the fitting portion of the base 1 and the case 5. A slit-like recessed portion 72 is formed on both sides and the central part at the edge of the upper surface (side opposite to the sealing hole 71) of the case 5. A recessed area 73 that is depressed from the upper surface is formed between the recessed portions 72, and a protrusion 74 is formed at the central part of the respective upper surface.

An arc extinguishing member 75 is attached to the case 5 using the recessed portion 72 and the recessed area 73.

The arc extinguishing member 75 is configured with a pair of permanent magnets 76 arranged at a predetermined interval to extinguish an arc, and a connection member 77 made of a magnetic material for magnetically connecting the permanent magnets 76.

Each of the permanent magnets 76 has a substantially cuboid shape, and are arranged so that the opposing surfaces have different polarities while being attached to the inner surfaces of the opposing walls 78 of the connection member 77. The polarities of the opposing surfaces are to be set such that the direction of the force acting on the arc current is directed toward an intermediate wall 79 of the connection member 77, according to the difference in the direction the current flows between the contacts. According to the configuration, the arc current can be deformed to a position where the adverse affect of the arc current is applied the least, and then extinguished The connection member 77 is bent such that the end sides face each other by press working a plate-like magnetic material. The permanent magnet 76 is adsorbed and fixed by its magnetic force to the inner surface of each opposing wall 78. An intermediate projecting section 80 located between the opposing walls 78 is formed on the intermediate wall 79 of the connection member 77 by raising the side parts from different end sides. Each intermediate projecting section 80 is located at the central part of the opposing walls 78 and projects out between the contact open/close positions to play a role of shortening the magnetic path. In other words, the magnetic flux generated from the permanent magnet 76 forms a closed loop in the magnetic circuit that passes through the intermediate wall 79 and each opposing wall 78 through the intermediate projecting section 80 and returns to the permanent magnet 76.

Thus, according to the arc extinguishing member 75, not only the pair of permanent magnets 76, but also the connection member 77 for magnetically connecting the permanent magnets 76 is arranged. The magnetic circuit is thus formed, and the magnetic flux leakage is less likely to occur. Furthermore, the magnetic path can be set short by arranging the intermediate projecting section 80. Therefore, the magnetic efficiency can be enhanced. As a result, even if arc is generated at the time of contact opening/closing, the arc is extended toward the side by the Fleming's left hand rule, and can be extinguished in a short period of time.

An assembly method of the electromagnetic relay having the above configuration will now be described.

The coil 24 is wound around the body portion 27 of the spool 23 and the coil terminal 36 is press-fitted and fixed to the lower end guard portion 29. The ends of the coil 24 are wound and soldered to the coil winding portion 39. The iron core 22 is inserted to the center hole 26 of the spool 23 from the lower end side, and the yoke 41, in which the hinge spring 44 is attached in advance, is swaged and anchored to a portion projecting out from the upper end. The electromagnet block 2 is thereby completed.

In the completed electromagnet block 2, the moving iron 4 is pivotably supported at the lower end section of the yoke 41 using the hinge spring 44. In this state, the first projecting section 66 of the card member 65 integrated with the moving iron 4 can come into contact with the yoke 41, and the elastic contacting portion 46 of the hinge spring 44 can touch and separate the second projecting section 67 of the card member 65. The electromagnet block 2 attached with the moving iron 4, and the contact switching unit 3 are then attached to the base 1.

In the attachment of the electromagnet block 2, the coil terminal 36 is press-fitted into the coil terminal hole 11 of the base 1, and the side parts of the yoke 41 are inserted to the guide groove 15 of the guide wall 13. In the attached state, the guide projection 35 is located in the supporting recessed portion 10, and the electromagnet block 2 is located in the YY' direction. The lower end face of the projecting section 42 of the yoke 41 and the bottom surface of the terminal attachment portion 31 respectively come into contact with the bottom surface of the recessed area 9 of the base 1. Thus, a gap in which the moving iron 4 can pivot is formed between the bottom surface of the recessed area 9 of the base 1 and the bottom surface of the lower end guard portion 29 of the spool 23. The shielding wall 70 of the card member 65 integrated with the moving iron 4 is then arranged over the insulating wall 14 of the base 1. In this case, the insulating property between the electromagnet block 2 and the contact switching unit 3 is sufficiently ensured by the guide wall 13 and the insulating wall 14 of the base 1, and the upper portion of the card member 65 and the shielding wall 70.

In the attachment of the contact switching unit 3, the press-fit portion 58 of the movable touch piece 52 is press-fitted into the first terminal hole 18 of the base 1. In the attachment of the movable touch piece 52, the protrusion 61 is located in the communicating portion 19, so that the attachment state of the movable touch piece 52 can be checked from the bottom surface of the base 1. The pushing portion 69 of the card member 65 attached first is pressure contacted to the upper end section of the movable touch piece 52, and the moving iron 4 is located at an initial position where the section 63 to be drawn is spaced apart from the magnet pole section 25 of the iron core 22 by the elastic force of the movable touch piece 52.

The terminal portion 54 of the fixed touch piece 51 is then inserted to the second terminal hole 21 of the base 1, and the press-fit portion 53 is press-fitted and fixed. In this state, the fixed touch piece 51 faces the movable touch piece 52 with a predetermined space, so that the movable contact 62 can touch and separate the fixed contact 57.

The arc extinguishing member 75 is then attached to the case 5. In the attachment of the arc extinguishing member 75, the opposing wall 78 and the permanent magnet 76 of the connection member 77, and the intermediate projecting section 80 are respectively inserted to each recessed portion 72 formed in the case 5 with the permanent magnet 76 attached to the opposing wall 78 of the connection member 77. The case 5 attached with the arc extinguishing member 75 is placed over the base 1, and the fitting portions thereof are sealed.

The internal space is to be in a sealed state by thermally sealing the sealing hole 71. However, use can be made with the internal space communicating with the surrounding atmosphere and with the sealing hole 71 opened.

The operation of the electromagnetic relay having the above configuration will now be described.

In a state that a current does not flow in the coil 24 and the electromagnet block 2 is demagnetized, the section 63 to be drawn is located at an initial position spaced apart from the magnet pole section 25 of the iron core 22 with the fulcrum, at which the moving iron 4 is supported by the yoke 41 by an elastic force of the movable touch piece 52, as the center. Therefore, the opened state in which the movable contact 62 is spaced apart from the fixed contact 57 is maintained.

Figure 9:
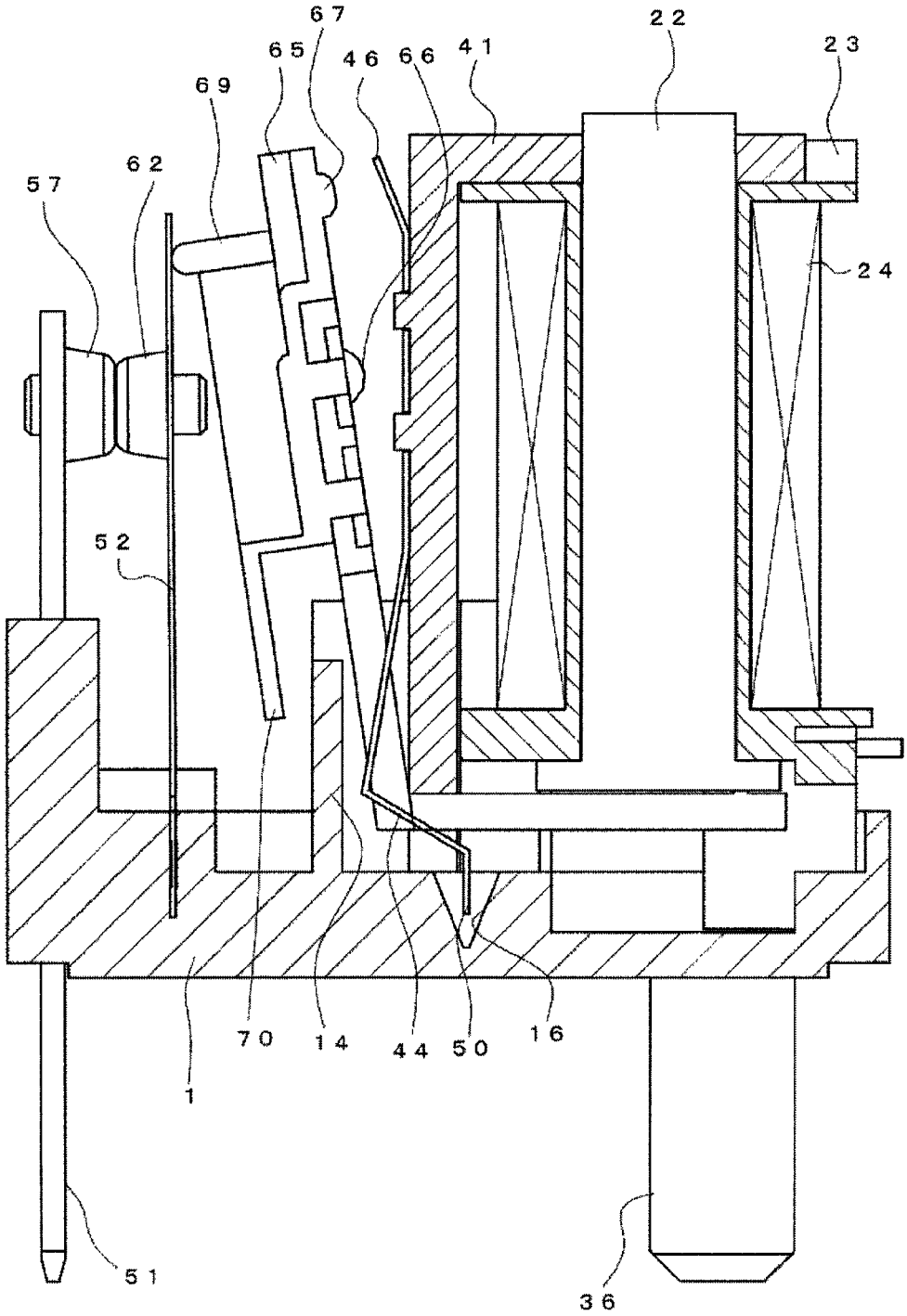
FIG. 9 is a cross-sectional view at the time of contact closing showing a state in which the case is removed from FIG. 1.
Figure 10:
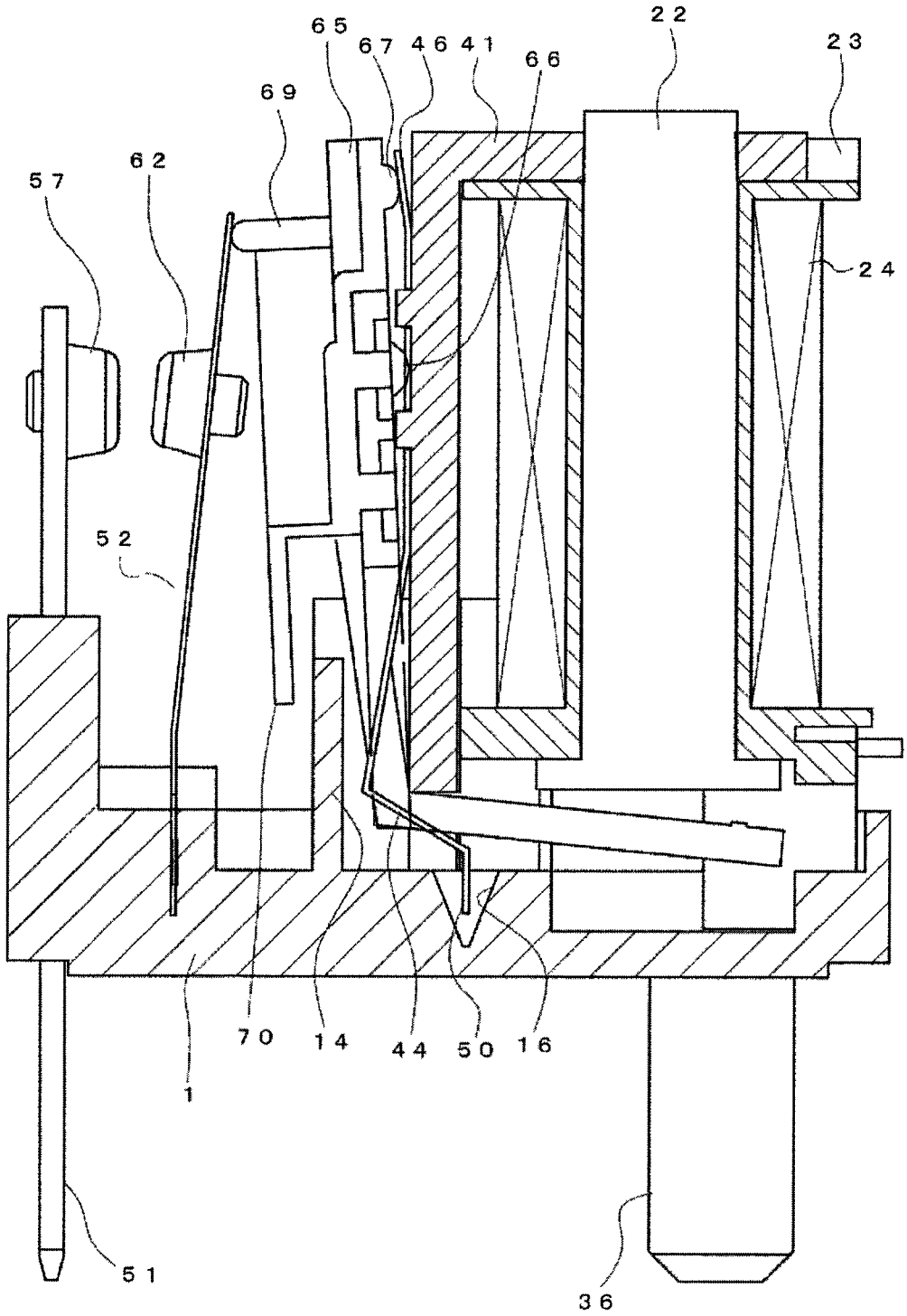
FIG. 10 is a cross-sectional view at the time of contact opening showing a state in which the case is removed from FIG. 1.

If a current flows in the coil 24 and the electromagnet block 2 is magnetized, the moving iron 4 has the section 63 to be drawn to the magnet pole section 25 of the iron core 22 and is pivoted against the biasing force of the movable touch piece 52, as shown in FIG. 9. The movable touch piece 52 is thereby elastically deformed, and the movable contact 62 closes with respect to the fixed contact 57 of the fixed touch piece 51.

If the current flow in the coil 24 is shielded and the electromagnet block 2 is demagnetized, the moving iron 4 loses the drawing force of the iron core 22 and pivots by the elastic force of the movable touch piece 52. In this case, the second projecting section 67 formed on the card member 65 of the moving iron 4 first collides with the elastic contacting portion 46 of the hinge spring 44. The second projecting section 67 is made of synthetic resin, and the elastic contacting portion 46 elastically deforms. Furthermore, the contacting state of the second projecting section 67 and the elastic contacting portion 46 is obtained at an early stage from the start of the pivoting of the moving iron 4. Therefore, the collision sound barely generates. The first projecting section 66 made of synthetic resin comes into contact with the middle part of the yoke 41 while elastically deforming the elastic contacting portion 46 by further pivoting the moving iron 4. Thus, the pivoting speed of the moving iron 4 is reduced, and the generation of collision noise is sufficiently suppressed. Thus, the moving iron 4 can be smoothly returned to the initial position without generating the collision noise, and the movable contact 62 is located at the opened position spaced apart from the fixed contact 57.

The arc sometimes generates between the contacts when opening the contacts. In this case, since the arc extinguishing member 75 is arranged at the periphery of the contact opening/closing region, the generated arc is rapidly extinguished.

In other words, the magnetic flux generated from the N pole of each permanent magnet 76 flows through the magnetic circuit of passing through the intermediate wall 79 via the intermediate projecting section 80 of the connection member 77, and returning to the S pole of each permanent magnet 76 from the opposing wall 78. Each magnetic circuit configures a closed loop, and there is barely any magnetic flux leakage to the periphery. The magnetic force thus can be effectively acted on the contact open/close position, that is, the arc generated between the contacts due to the presence of the intermediate projecting section 80. As a result, the force acts in the direction perpendicular to the contact opening direction on the generated arc due to the Fleming's left hand rule, and the arc is greatly extended and thus can be rapidly extinguished.

Figure 11:
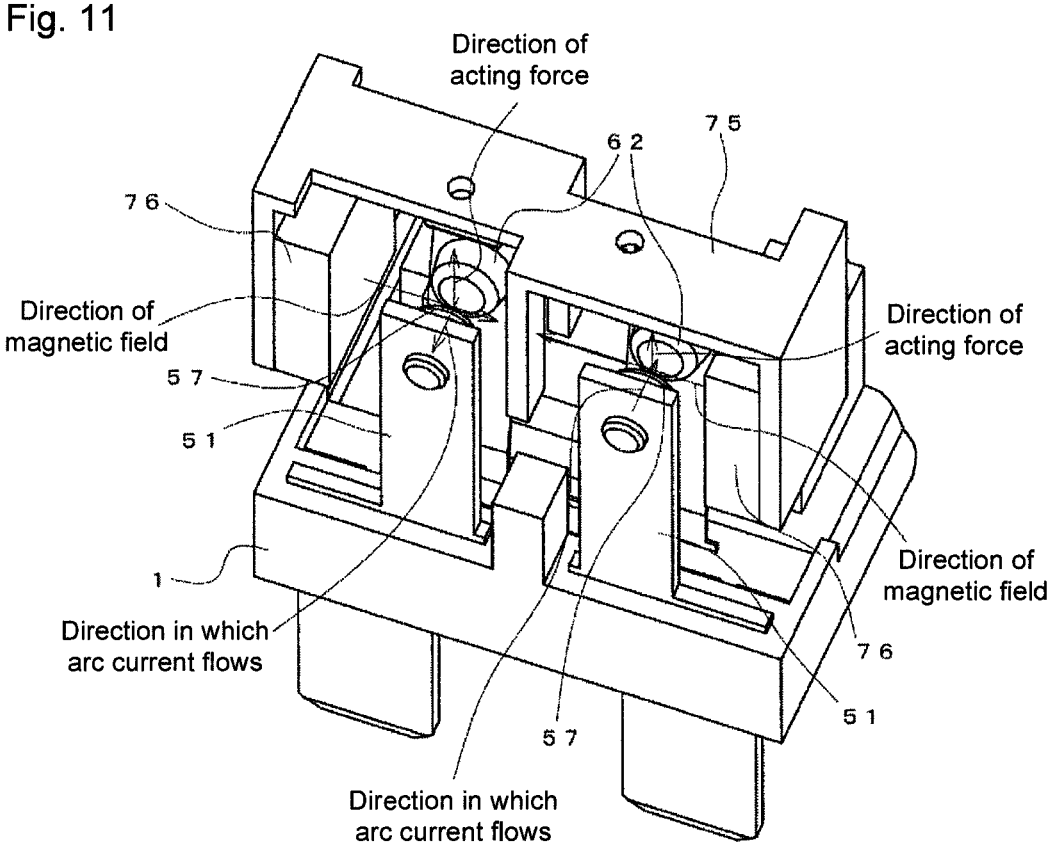
FIG. 11 is an enlarged perspective view of a contact switching unit of FIG. 3.

Since the movable touch piece 52 is configured to open and close the fixed touch pieces 51, the arc current at the time of the contact opening flows in the direction shown in FIG. 11, whereby the magnet poles of the permanent magnets 76 are set to be different poles on the opposing surfaces so that the magnetic flux direction capable of deforming the arc toward the intermediate wall of the connection member 77 is obtained. That is, the arc can be more reliably extinguished by deforming the arc toward the intermediate wall of the connection member 77. Therefore, when the configuration of the contact switching unit 3 differs, the magnet poles of the permanent magnets 76 are to be set according to the difference.

The operation voltage of the electromagnet block 2 can be adjusted in the following manner.

Figure 12:
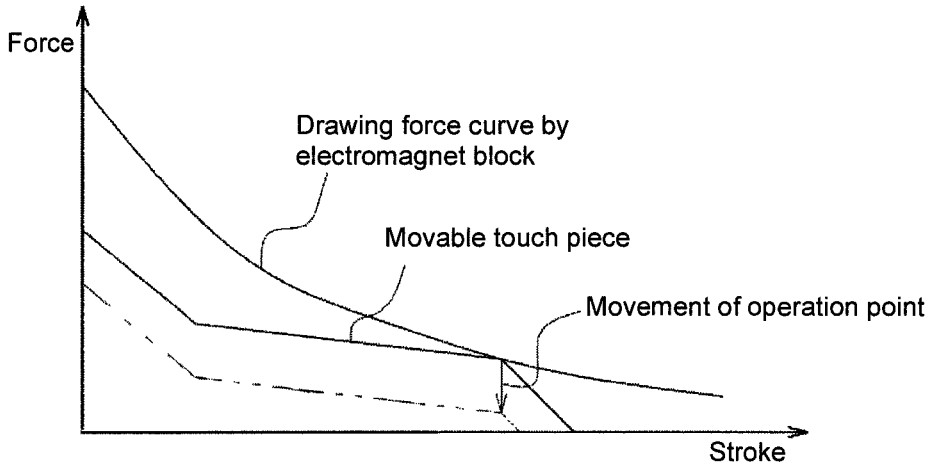
FIG. 12 is a graph showing a drawing force curve by the electromagnet block of FIG. 4 and change in the force that acts on a movable touch piece.

In other words, the operation voltage of the electromagnet block 2 can be suppressed by changing the inclination angle of the elastic contacting portion 46 of the hinge spring 44. Specifically, when the inclination angle of the elastic contacting portion 46 with respect to the yoke 41 is made large, the position of the operation point can be changed with respect to the change (drawing force curve) in the force acting on the section 63 to be drawn of the moving iron 4 by the magnetic field generated from the magnet pole section 25 of the iron core 22, as shown in the graph of FIG. 12. That is, the force from when the contacts are opened until the elastic contacting portion 46 comes into contact with the first projecting section 66 can be made small to suppress the force required at that time by making the inclination angle of the elastic contacting portion 46 large. As a result, the operation voltage of the electromagnet block 2 can be suppressed so that the drawing force curve changes at a position smaller than the illustrated position.

The present invention is not limited to the configuration described in the above embodiment, and various changes can be made.

For example, in the embodiment described above, the movable touch piece 52 is configured with a pair of touch pieces extending from the press-fit portion 37, but may be configured with two members (two movable touch pieces 52). Furthermore, the fixed touch piece 51 is configured with two members, but may have a continuous integrated configuration, similar to the movable touch piece 52.

The combination of the movable touch piece 52 and the fixed touch piece 51 may be one group of combination or may be three or more groups of combinations.

The arc extinguishing member 75 may be configured as below.

Figure 13:
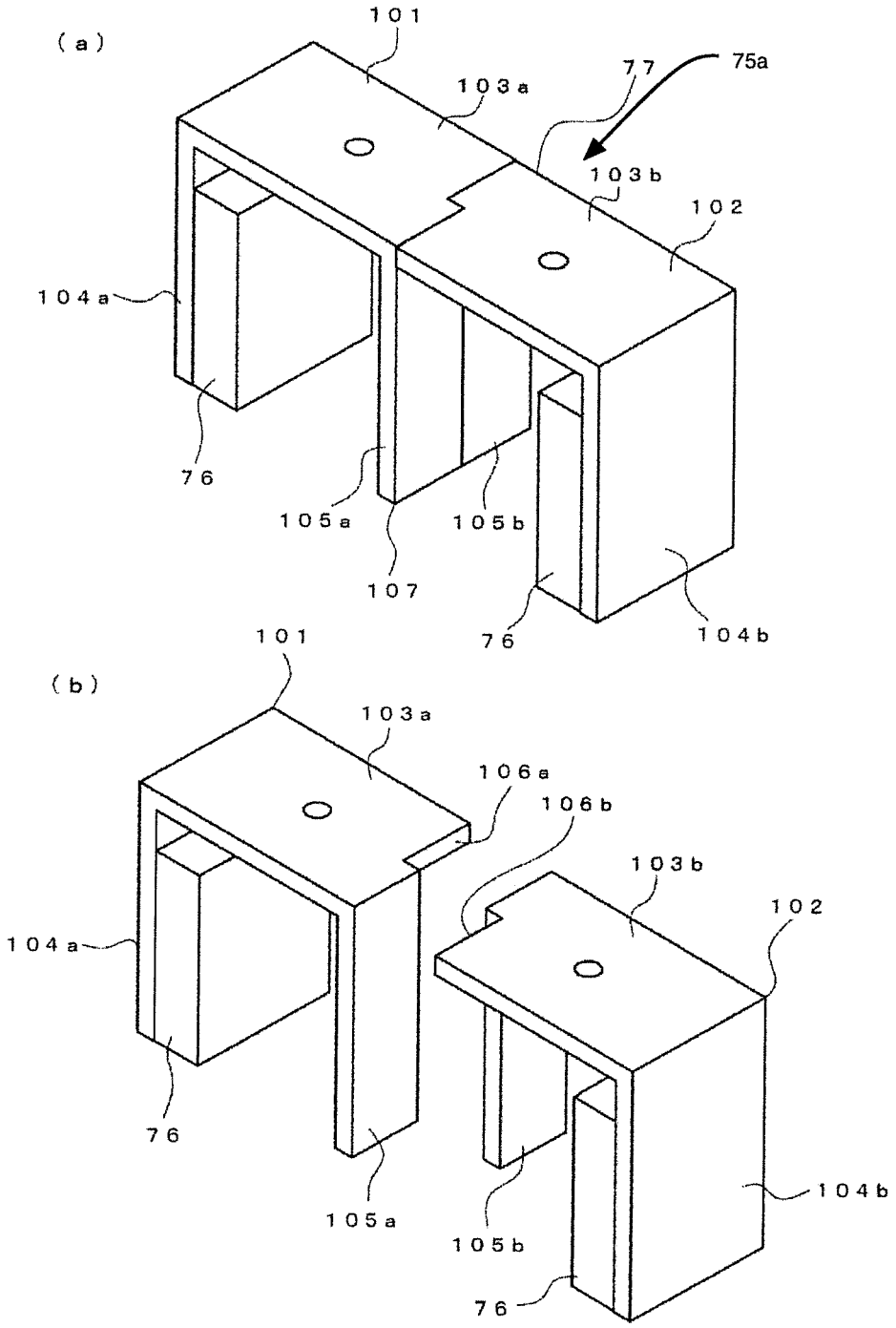
FIG. 13(*a*) is a perspective view showing an arc extinguishing member according to another embodiment, and FIG. 13(*b*) is a perspective view exploded to a first connecting portion and a second connecting portion.

FIG. 13 shows arc extinguishing member 75*a* in which the connection member 77 is configured with a first connecting portion 101 and a second connecting portion 102. At one end of each connecting portion 101, 102 is formed a first side wall 104*a*, 104*b*, similar to the opposing wall of the embodiment described above, that is bent at right angle from an intermediate wall 103*a*, 103*b*. At the other end of each connecting portion 101, 102 is formed a second side wall 105*a*, 105*b* in which only a half in the width direction is bent. A step difference (depressed portion 106*a*, 106*b*) having a thickness of the second side wall 105*a*, 105*b* is formed on an end face on the second side wall 105*a*, 105*b* side of the intermediate wall 103*a*, 103*b*. The first connecting portion 101 and the second connecting portion 102 are arranged to form a substantially E shape by aligning the second side walls 105*a*, 105*b* to the step difference. In this case, not only the side parts, as in the embodiment described above, but also a flat plate-shaped intermediate projecting section 107 that extends entirely can be formed with the second side wall 105*a*, 105*b* of each connecting portion 101, 102. The permanent magnet 76 is attached to the inner surface of each first side wall 104*a*, 104*b* by magnetic force.

According to the configuration, the magnetic flux leakage can be more effectively prevented compared to the above-described embodiment, and the magnetic flux can be sufficiently concentrated between the contacts without using the permanent magnet 76 having a very large magnetic force.

Figure 14:
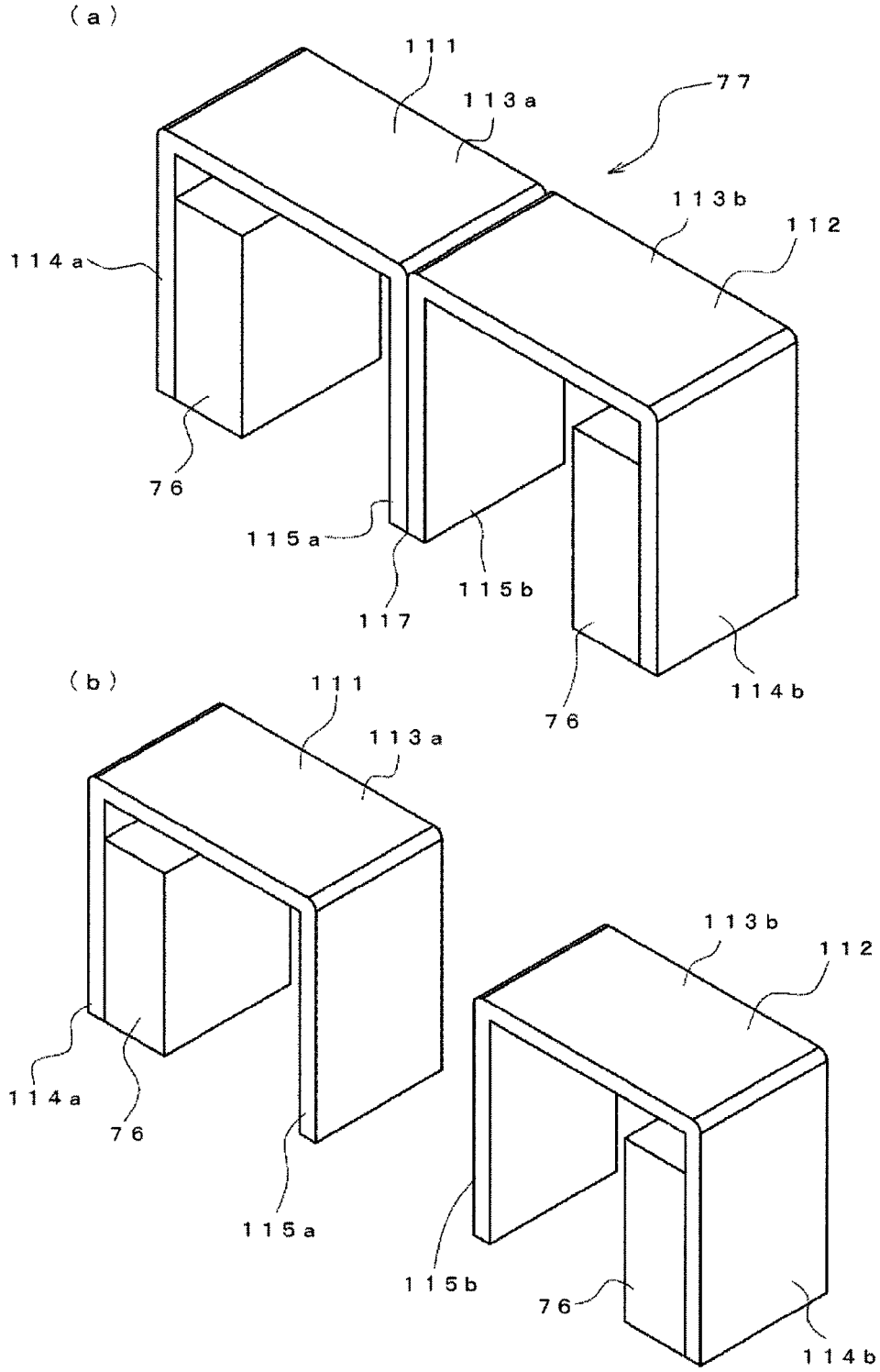
FIG. 14(*a*) is a perspective view showing an arc extinguishing member according to another embodiment, and FIG. 14(*b*) is a perspective view exploded to a first connecting portion and a second connecting portion.

Similar to FIG. 13, the connection member 77 is configured with a first connecting portion 111 and a second connecting portion 112 in FIG. 14. However, the difference lies in that a second side wall 115*a*, 115*b* does not have a configuration in which only a half is bent, but has a configuration of being entirely bent at right angle from an intermediate wall 113*a*, 113*b*, similar to a first side wall 114*a*, 114*b*. The first connecting portion 111 and the second connecting portion 112 are used with the outer surfaces of the second side walls 115*a*, 115*b* brought into contact to form an intermediate projecting section 117.

According to the configuration, a closed loop of the magnetic circuit can be formed at each contact open/close position of two groups, so that the magnetic flux leakage can be more effectively prevented.

Figure 15:
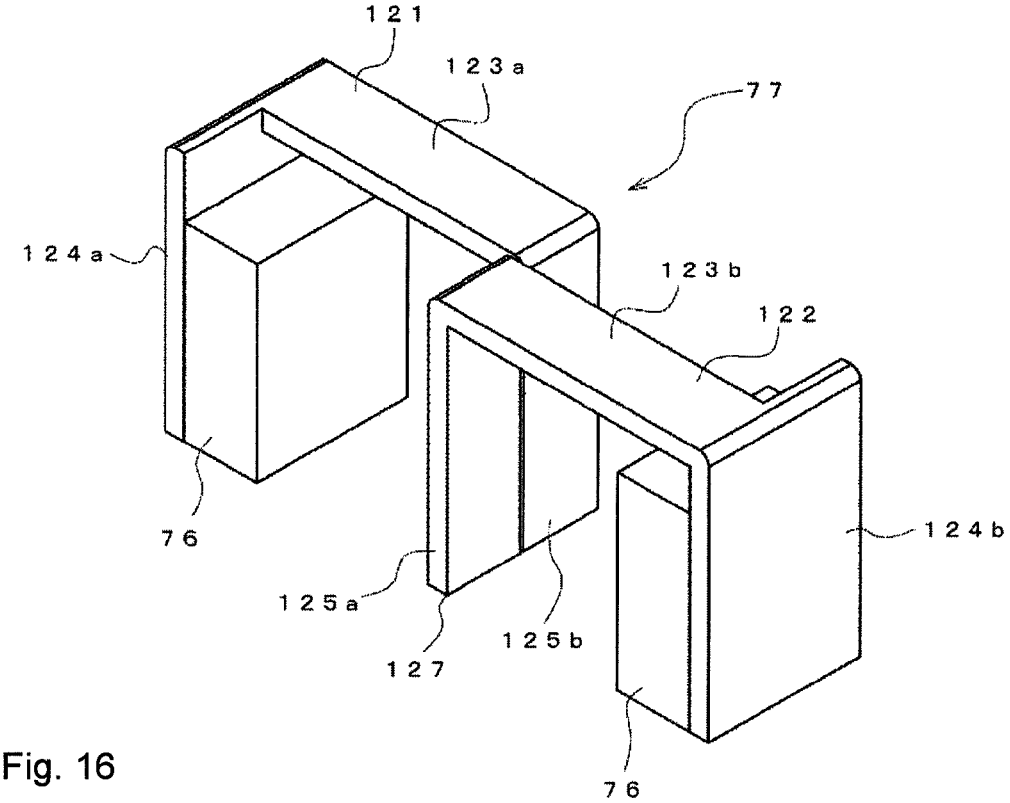
FIG. 15 is a perspective view showing an arc extinguishing member according to another embodiment.

In FIG. 15, the connection member 77 is configured with a first connecting portion 121 and a second connecting portion 122, substantially similar to the configuration of the connection member 77 according to the embodiment described above. Each connecting wall 121, 122 includes a first side wall 124*a*, 124*b*, an intermediate wall 123*a*, 123*b*, which has a width of half of the first side wall 124*a*, 124*b*, and a second side wall 125*a*, 125*b* formed by bending the intermediate wall 123*a*, 123*b* at right angle. The first connecting portion 121 and the second connecting portion 122 are used with the side surfaces of the second side walls 125*a*, 125*b* brought into contact to form an intermediate projecting section 127.

According to the configuration, the intermediate projecting section 127 can be arranged not only at the side parts, as in the embodiment described above, and the intermediate projecting section 127 can be arranged over substantially the entire surface, similar to FIG. 13. Thus, similar to FIG. 13, the magnetic flux leakage can be effectively prevented.

Figure 16:
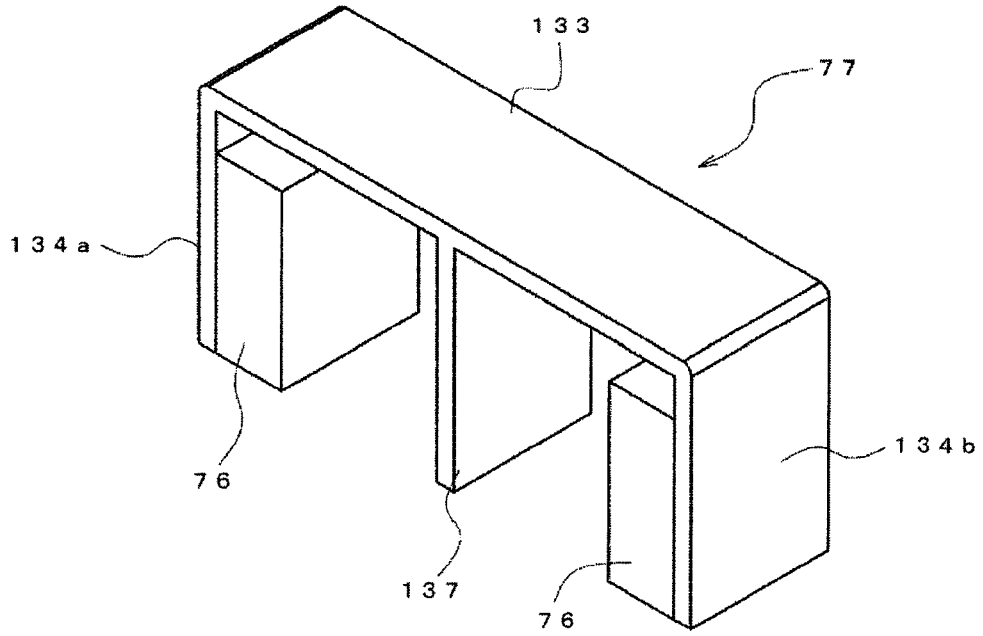
FIG. 16 is a perspective view showing an arc extinguishing member according to another embodiment.

In FIG. 16, an intermediate projecting section 137 is formed with a flat plate integrally projecting out from a central part of an intermediate wall 133. The intermediate projecting section 137 may be integrated with a plate material having the same shape as the opposing walls 134*a*, 134*b* to a member having a substantially horseshoe shape formed with an intermediate wall 133 and opposing walls 134*a*, 134*b* by welding, adhering, and the like at the central part of the intermediate wall 133, or may be simultaneously formed with the opposing walls at the time of press working. According to the configuration, the magnetic flux can be concentrated at the contact open/close position while effectively preventing the magnetic flux leakage to a maximum without configuring with two members or without forming a gap, and the like, as in the embodiments described above.

According to the present invention, the connection member is arranged at the periphery of the contact open/close position, and the permanent magnets are arranged at the opposing portions, so that the magnetic field generated from the permanent magnets can be effectively concentrated at the contact open/close position. In particular, since the projecting section of the connection member is located between the contact open/close positions, the length of the generated magnetic flux that passes through space can be reduced to suppress the occurrence of the leakage magnetic flux, and the magnetic flux can be concentrated at the contact open/close position. Thus, even if the arc current is generated at the time of contact opening/closing, the arc current can be deformed to the upper side by the magnetic field and extinguished at an early stage.

There has thus been shown and described an electromagnetic relay using the same which fulfills all the advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An electromagnetic relay comprising:

a contact switching unit formed by arranging at least two contact groups in parallel with each other and perpendicular to a touch/separation direction of the contacts, each of the contact groups includes a pair of contacts which are adapted to touch each other and separate from each other;

an electromagnet block adapted to drive the contact switching unit to open/close the contacts; and an arc extinguishing member including a connection member made from a magnetic material and formed by a) a connection of projecting sections that respectively project out from both sides of a middle part of said connection member in the direction of the parallel arrangement of the contact groups and between the contact groups, and b) opposing walls that respectively project out from ends of said connection member, and permanent magnets respectively affixed by their magnetic force to the opposing walls.

2. The electromagnetic relay according to claim 1, further comprising a case to be attached to a base to cover the contact switching unit and the electromagnet block, the case includes a recessed portion to which the projecting sections and the permanent magnet of the arc extinguishing member are arranged.

3. The electromagnetic relay according to claim 2, wherein a polarity of an opposing surface of each permanent magnet and a direction in which an arc current generated at a time of contact opening/closing flow are determined so that a force of displacing toward the middle part of the connection member is generated on the arc current.

4. The electromagnetic relay according to claim 2, wherein a polarity of an opposing surface of each permanent magnet and a direction in which an arc current generated at a time of contact opening/closing flow are determined to be opposite directions between the adjacent contact open/close positions.

5. The electromagnetic relay according to claim 1, wherein a polarity of an opposing surface of each permanent magnet and a direction in which an arc current generated at a time of contact opening/closing flow are determined so that a force of displacing toward the middle part of the connection member is generated on the arc current.

6. The electromagnetic relay according to claim 1, wherein a polarity of an opposing surface of each permanent magnet and a direction in which an arc current generated at a time of contact opening/closing flow are determined to be opposite directions between the adjacent contact open/close positions.

7. The electromagnetic relay according to claim 1, further comprising a base to be attached with the contact switching unit and the electromagnet block, wherein the contact is fixed to one end section of a touch piece that projects out from the base, and the arc extinguishing member has the middle part of the connection member arranged near the contact on a projecting direction side of the touch piece.

8. The electromagnetic relay according to claim 1, wherein the connection member of the arc extinguishing member is formed by an opposing wall at both ends of an intermediate wall, and side parts are raised from the opposing wall side on opposite sides with respect to a central part to form the projecting section located between the contact groups at the central part of the intermediate wall.

9. The electromagnetic relay according to claim 1, wherein the connection member of the arc extinguishing member includes a first connecting portion and a second connecting portion, each connecting portion being configured by forming a first side wall and a second side wall at both ends of the intermediate wall so as to face each other; and the projecting section located between the contact groups is configured by the second side walls.

10. The electromagnetic relay according to claim 9, wherein the second side wall of the first connecting portion and the second side wall of the second connecting portion define a flat plate-shaped wall surface portion.

11. An electromagnetic relay comprising:

a contact switching unit having a fixed touch piece and a movable touch piece facing the fixed touch piece;

an electromagnet block adapted to be magnetized or demagnetized and to drive the movable touch piece so that a movable contact arranged in the movable touch piece opens/closes with respect to a fixed contact arranged in the fixed touch piece, wherein at least two fixed touch pieces have the fixed contact;

the movable touch piece includes at least a pair of contact piece portions including the movable contact, and an arc extinguishing member including a) a connection member having projecting sections projecting out from both sides of each touch piece portion and connected with each other via a middle part of said connection member between the open/close positions of the contact, and b) opposing walls that respectively project out from ends of said connection member, and permanent magnets respectively affixed by their magnetic force to the opposing walls.

12. The electromagnetic relay according to claim 1, wherein the connection member of the arc extinguishing member is formed by an opposing wall at both ends of an intermediate wall, and side parts are raised from the opposing wall side on opposite sides with respect to a central part to form the projecting section located between the contact groups at the central part of the intermediate wall.

13. The electromagnetic relay according to claim 12, wherein a flat plate-shaped wall surface portion is configured by the projecting sections.

* * * * *